US007756404B2

(12) United States Patent
Schubert et al.

(10) Patent No.: US 7,756,404 B2
(45) Date of Patent: Jul. 13, 2010

(54) MICROSTRUCTURED APPARATUS FOR HEATING A FLUID

(75) Inventors: Klaus Schubert, Karlsruhe (DE); Jürgen Brandner, Heidelberg (DE)

(73) Assignee: Forschungszenlrum Karlsruhe GmbH, Karlsruhe (DE)

( * ) Notice: Subject to any disclaimer, the term of this patent is extended or adjusted under 35 U.S.C. 154(b) by 208 days.

(21) Appl. No.: 11/999,973

(22) Filed: Dec. 8, 2007

(65) Prior Publication Data

US 2008/0089676 A1 Apr. 17, 2008

Related U.S. Application Data

(63) Continuation-in-part of application No. 10/987,684, filed on Nov. 12, 2004, now abandoned.

(51) Int. Cl.
*F24H 1/10* (2006.01)

(52) U.S. Cl. ..... 392/478; 392/481; 392/484

(58) Field of Classification Search ..... None
See application file for complete search history.

(56) References Cited

U.S. PATENT DOCUMENTS 1,442,258 A * 1/1923 Dorris ..... 123/548
2,060,936 A * 11/1936 Haag, Jr. ..... 165/156
3,584,194 A * 6/1971 Kautz et al. ..... 392/484
3,643,733 A * 2/1972 Hall et al. ..... 165/81
3,835,294 A * 9/1974 Krohn et al. ..... 392/484
3,854,032 A * 12/1974 Cooper ..... 219/383
4,199,675 A * 4/1980 Sharpless ..... 392/484
4,214,147 A * 7/1980 Kraver ..... 392/468
4,218,999 A * 8/1980 Shearer ..... 123/557
4,436,075 A * 3/1984 Campbell et al. ..... 123/557
4,458,642 A * 7/1984 Okubo et al. ..... 123/196 AB
4,465,922 A * 8/1984 Kolibas ..... 392/484
4,480,172 A * 10/1984 Ciciliot et al. ..... 392/396
4,562,890 A * 1/1986 Matoba ..... 165/41
4,582,040 A * 4/1986 Niblett ..... 123/557
4,944,343 A * 7/1990 Muller ..... 165/47
5,067,094 A * 11/1991 Hayes ..... 702/51
5,097,813 A * 3/1992 Reiser et al. ..... 123/557
5,118,451 A * 6/1992 Lambert et al. ..... 261/144
5,226,596 A * 7/1993 Okamura ..... 239/1
5,249,623 A * 10/1993 Muller et al. ..... 165/156
5,265,318 A * 11/1993 Shero ..... 29/447
5,271,086 A * 12/1993 Kamiyama et al. ..... 392/483
5,287,758 A * 2/1994 Geiss et al. ..... 73/864.01
5,522,453 A * 6/1996 Green ..... 165/41
5,596,973 A * 1/1997 Grice ..... 123/557
5,957,384 A * 9/1999 Lansinger ..... 239/284.1
5,974,803 A * 11/1999 Hammerschmid ..... 60/643
6,032,324 A * 3/2000 Lansinger ..... 15/250.04

(Continued)

*Primary Examiner*—Thor S Campbell
(74) *Attorney, Agent, or Firm*—Klaus J. Bach

(57) ABSTRACT

In a microstructure apparatus for heating and atomizing a fluid with an inner body received in an outer tube, circumferential microstructure passages are formed into the inner surface of the outer tube or the outer surface of the inner body so as to form a flow passage which is provided with an inlet connector and heating means are incorporated into the inner body for heating the fluid conducted through the microstructure flow passages under pressure, the microstructure fluid passages extending spirally around the inner body so as to proved for a relatively long microstructure fluid flow passage which is open at the axial end thereof for discharging the fluid heated pressurized therein through the open axial end.

15 Claims, 7 Drawing Sheets

U.S. PATENT DOCUMENTS 6,157,778 A * 12/2000 Kadotani ..... 392/483
6,219,490 B1 * 4/2001 Gibertoni et al. ..... 392/472
6,343,416 B1 * 2/2002 Miller et al. ..... 29/890.035
6,749,014 B2 * 6/2004 Ferraro ..... 165/156
2002/0023919 A1 * 2/2002 Toya et al. ..... 219/544
2004/0175166 A1 * 9/2004 Bartscher et al. ..... 392/481
2006/0088302 A1 * 4/2006 Sturm ..... 392/480

* cited by examiner

MICROSTRUCTURED APPARATUS FOR HEATING A FLUID

This is a Continuation-In-Part Application of U.S. application Ser. No. 10/987,684 filed Nov. 12, 2004 now abandoned and claiming the priority of German application 102 34 043.9 filed Jul. 26, 2002.

BACKGROUND OF THE INVENTION

The invention relates to a microstructure apparatus for heating and atomizing a fluid, comprising an inner tube surrounded by an outer tube and a microstructure formed at the interface between the inner and the outer tubes.

Microstructure apparatus for heating fluids are used particularly for a position-independent condensation-free evaporation of liquids and for continuous flow heating particularly of gases. Preferred areas of utilization are chemical or pharmaceutical processes and generally the chemical engineering field.

It is generally known to heat fluids by way of electric heating elements. This has the advantage that the heat transfer can be controlled rapidly and in a simple manner by controlling the electric power input. In this connection, microstructure apparatus have, the advantage that, because of the principally smaller dimensions, the heat transfer paths are short and a large specific heat transfer surface can be provided such that the volume-based heat transfer can be relatively high.

DE 199 17 521 A1 discloses such a microstructure apparatus including direct and indirect electrical resistance heaters for heating fluids. The microstructure apparatus comprises layers including microwave channels for the passage of a fluid to be heated and layers including electrical heaters. In comparison with a conventional heat exchanger which is not microstructured, a volume-specific increase of the heat transfer of at least the factor 100 is mentioned. The proposed inner structured apparatus however requires several heating elements with dimensions in the micro-range. For designing the microstructure apparatus for larger fluid flows a number of such heating elements are required and that number increases with the flow volume for added capacity. This is necessary particularly if the volume-specific heat transfer capacity of the microstructure apparatus must not be reduced.

It is therefore the object of the present invention to provide a microstructure apparatus for heating and atomizing fluids which has heating elements that are simple in their design and which, furthermore, provides for an extremely fine atomization of the fluid via the microstructure apparatus.

SUMMARY OF THE INVENTION

In a microstructure apparatus for heating and atomizing a fluid with an inner body received in an outer tube, circumferential microstructure passages are formed into the inner surface of the outer tube or the outer surface of the inner body so as to form a flow passage which is provided with an inlet connector and heating means are incorporated into the inner body for heating the fluid conducted through the microstructure flow passages under pressure, the microstructure fluid passages extending spirally around the inner body so as to proved for a relatively long microstructure fluid flow passage which is open at the axial end thereof for discharging the fluid heated pressurized therein through the open axial end.

It is particularly important that a relatively large or macroscopic heating element is used which has operational advantages in comparison with several micro-heating elements, such as comparatively simple handling and low cost and also use advantages, in combination with a microstructure with its advantage of high efficiency in the transfer of heat to a fluid as pointed out earlier.

The materials of which the microstructure apparatus is manufactured are determined mainly by the application for the apparatus. Basically any materials such as ceramics or other inorganic, non-metallic materials, metals, plastics or combinations or compounds of these materials are suitable.

Below the invention will be described in greater detail on the basis of some embodiments with reference to the accompanying drawings.

DESCRIPTION OF THE VARIOUS EMBODIMENTS

Figure 1A:
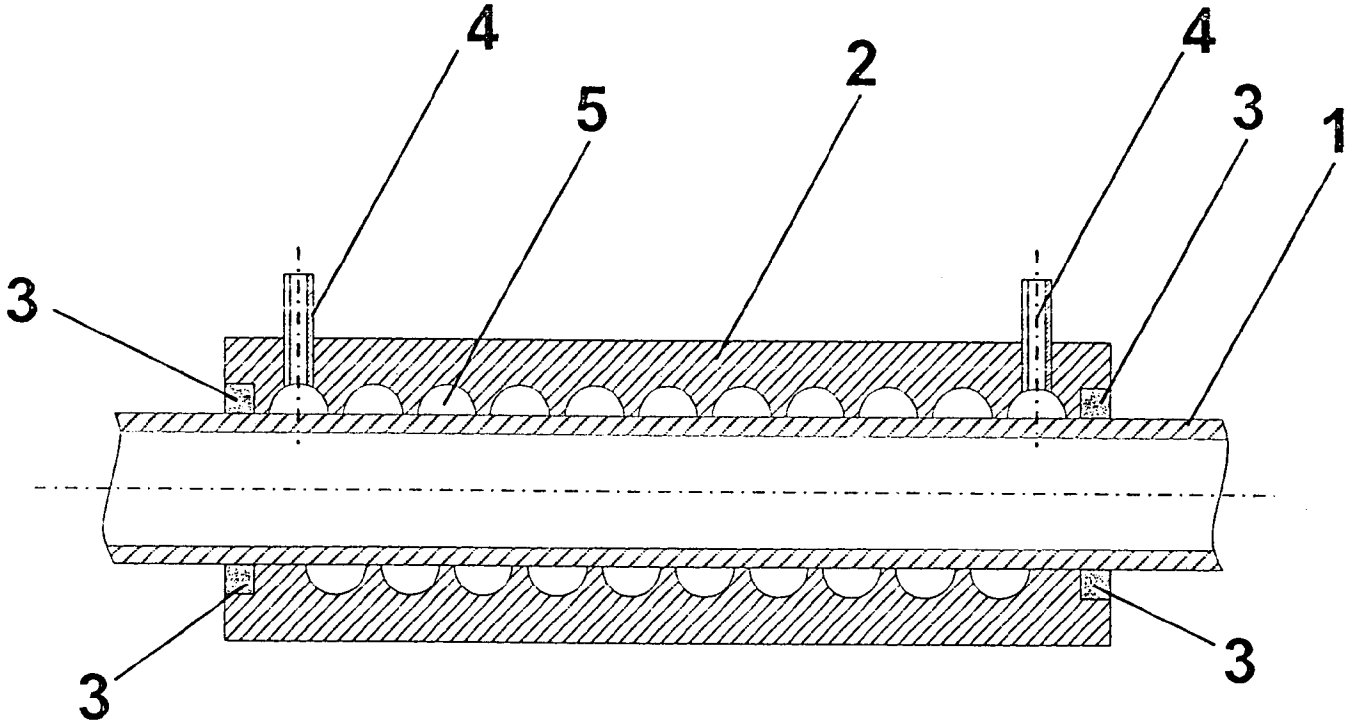
FIGS. 1*a*, 1*b*, 1*c*, 1*d*, 1*e*, 1*f* and 1*g* are cross-sectional views of different embodiments of the apparatus according to the invention.

The first embodiment, as shown in FIG. 1*a* comprises an inner tube 1 or another body with a preferably cylindrical outer surface, an outer tube 2 concentrically surrounding the inner tube 1 and having an inner surface in tight engagement with the inner tube 1. Inlet and outlet connectors 4 for a fluid are provided near the ends of the outer tube 2 and a microstructure 5 is formed in the interface area between the inner and outer tubes providing a volume in the form of a spiral passage extending between the fluid inlet and outlet connectors 4.

The microstructure is essentially encased between the inner and the outer tubes wherein, ideally, the inner and outer tubes are in sealing engagement at the contact areas.

The microstructure 5 is in the embodiment shown in FIG. 1*a* in the form of an internal thread formed into the inner surface of the outer tube 2 wherein the thread course forms a channel interconnecting the two fluid inlet and outlet connectors 4. In this case, the remaining areas of the cylindrical inner surface of the outer tube 2 with a diameter corresponding to the outer diameter of the inner tube 1 should sealingly engage the outer surface of the inner tube 1. The seal connections 3 between the inner and the outer tubes 1 and 2 are chemically, mechanically and thermally resistant ring seals disposed at the opposite ends of the outer tube 2. End covers may be provided to retain the seal rings or the tubes may be formed in these areas for example with cylindrical or conical fittings to hold the seal rings in place. Also, cement or solder connections may be provided for that purpose.

The inner tube 1, which is shown in all figures to be longer than the outer tube 2 extends at both ends from the outer tube 2, although this not necessary. This is also true for a body with a cylindrical outer surface which may be used in place of an inner tube 1 as mentioned earlier. The inner tube or such inner body is in all the embodiments directly or indirectly part of a heating structure. As a direct part of a heating structure, the tube or the body is an integral component of a heating device for example in the form of a resistance heating element. As an indirect part, the tube or the body is for example a heat conductor which conducts heat from a separate heater to the fluid to be heated. These may be separate heaters arranged within the inner tube or adaptively connected to the body. As heaters, electric resistance heating elements are considered to be particularly suitable. Alternatively, a heating medium may be conducted through the inner tube for heating the inner tube 1.

Figure 1B:
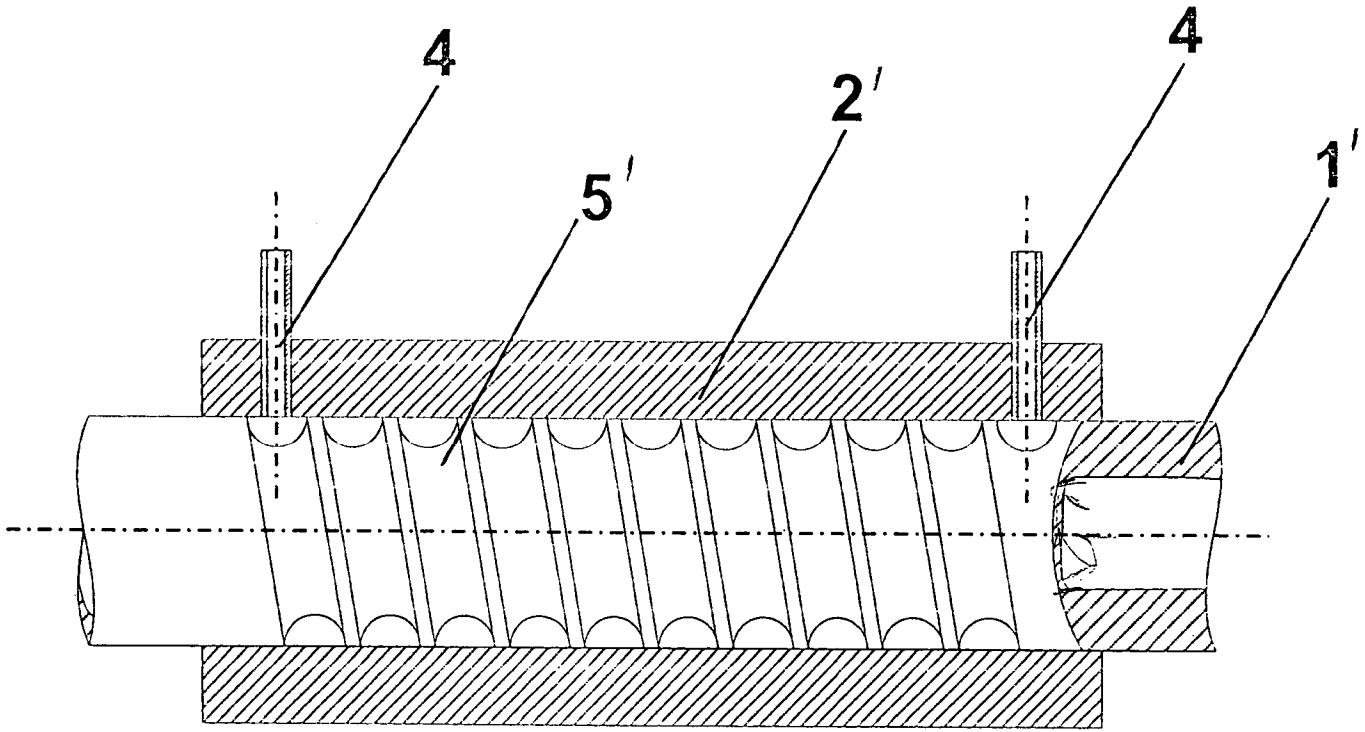

FIG. 1*b* shows a second embodiment which is different from the first embodiment (FIG. 1*a*) only in that the microstructure 5' is formed as an external thread into the outer surface of the inner tube 1' (or an inner cylindrical body), wherein the outer tube 2' has a smooth inner surface in contact with the inner tube 1'. As in the first embodiment connectors 4 are installed in the outer tube 2'. In this case, care has to be taken upon installation that the connectors are accurately positioned so as to be in communication with the microstructure 5'. With an appropriate sizing of the fit between the inner and the outer tube 1', 2', the contact surfaces are sealed so that the seals 3 shown in FIG. 1 are not needed.

Figure 1C:
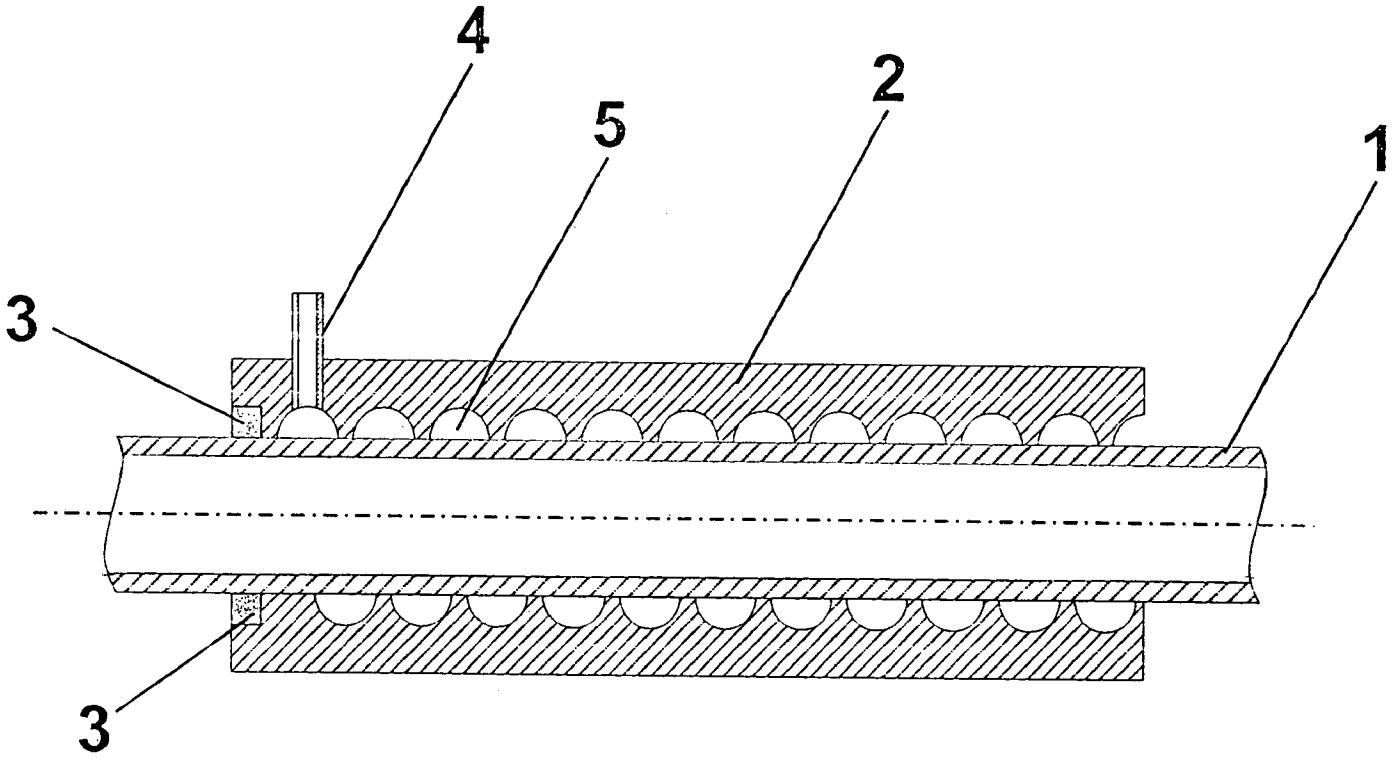

In a third embodiment as shown in FIG. 1*c*, one of the two connections is formed by an open end of the spiral microstructure passage 5 at one end of the outer tube 2.

Figure 1D:
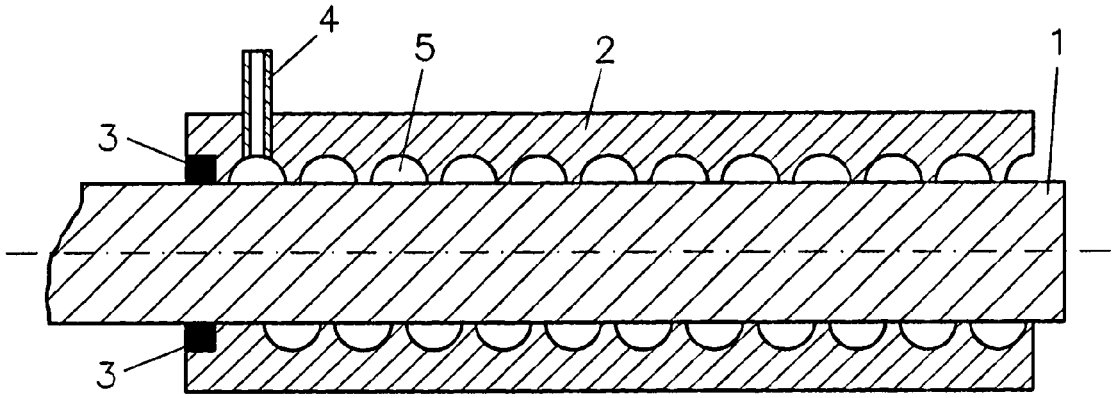

In FIG. 1*d* the inner body is in the form of an electric heating element.

Figure 1E:
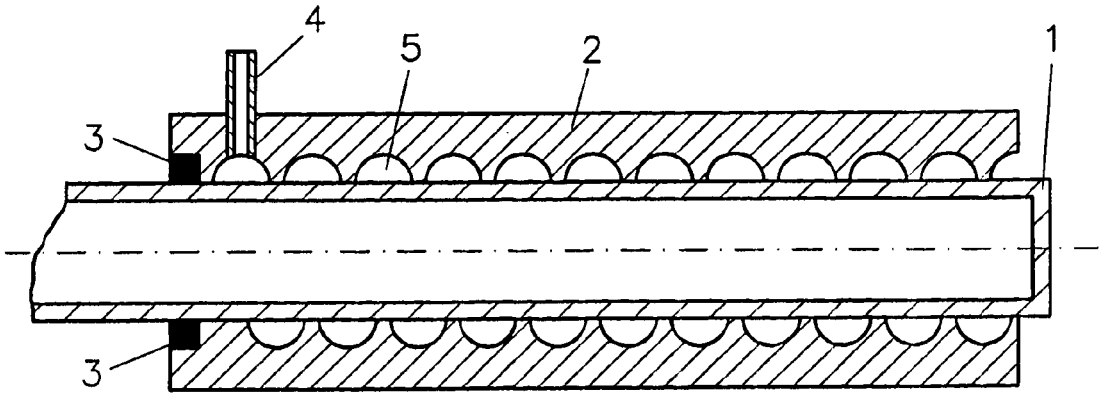

In FIG. 1*e* the inner body is in the form of a tube which is closed at the end for receiving a heating means.

Figure 1F:
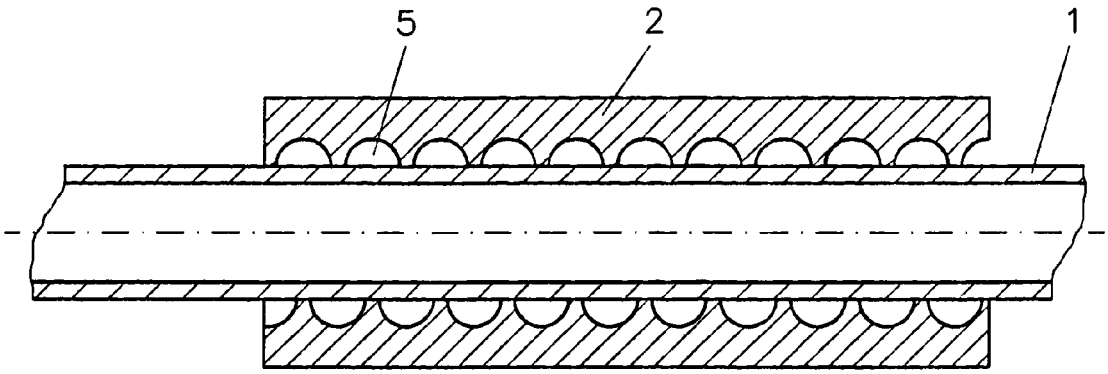
Figure 1G:
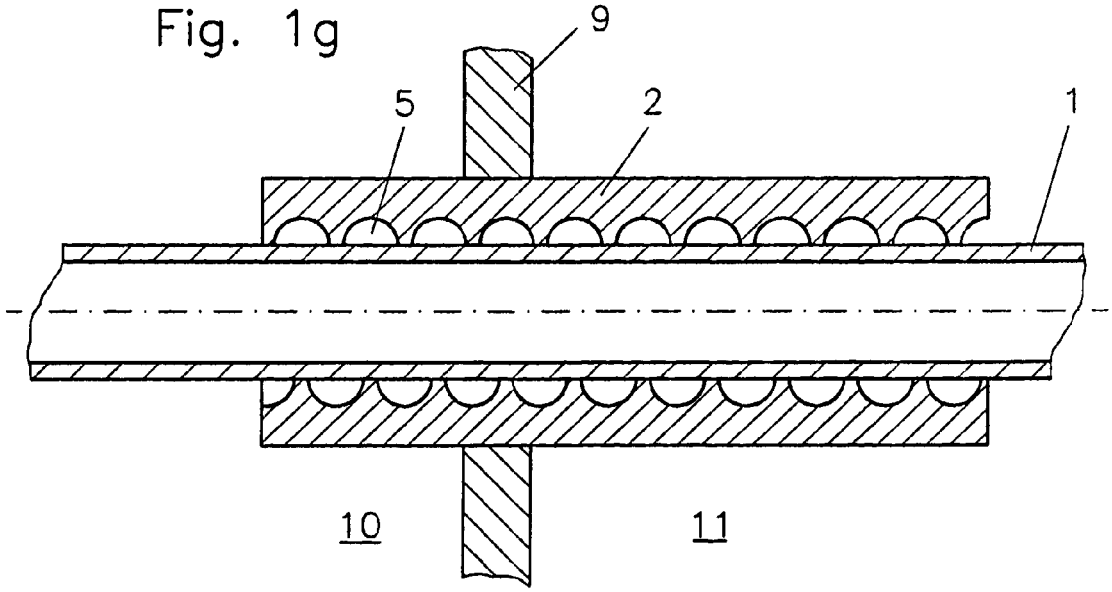

In FIG. 1*f* the inner body is in the form of a tube which extends through the outer tube and is adapted to accommodate a heated fluid for heating fluid flowing through the spiral microstructure passages, and In FIG. 1*e* the arrangement of FIG. 1*f* is shown extending through a wall 9, whereby fluid can be supplied to the microstructure apparatus at one side of the wall 9 and is discharged atomized at the other side of the wall 9.

Basically, also other embodiments are possible wherein both connections are provided by open ends of the thread-like microstructure passages. Such an arrangement could be miniaturized in a particularly advantageous manner since separate connectors or sealed connections would not be needed.

Such an embodiment could furthermore be used as continuous flow heater installed between two separate fluid volumes. Since, with such an arrangement, no fluid losses could occur by leakages, sealed connections between the inner and outer tubes would also not be necessary. Further uses for embodiments with the thread-like passages open at least at one end of the outer tube would be for example the atomizing of a liquid to a spray or an aerosol or in the gasification or vaporization of a liquid wherein the particular advantage of the microstructure apparatus resides in its particularly sensitive and accurately adjustable flow control capability.

Figure 2:
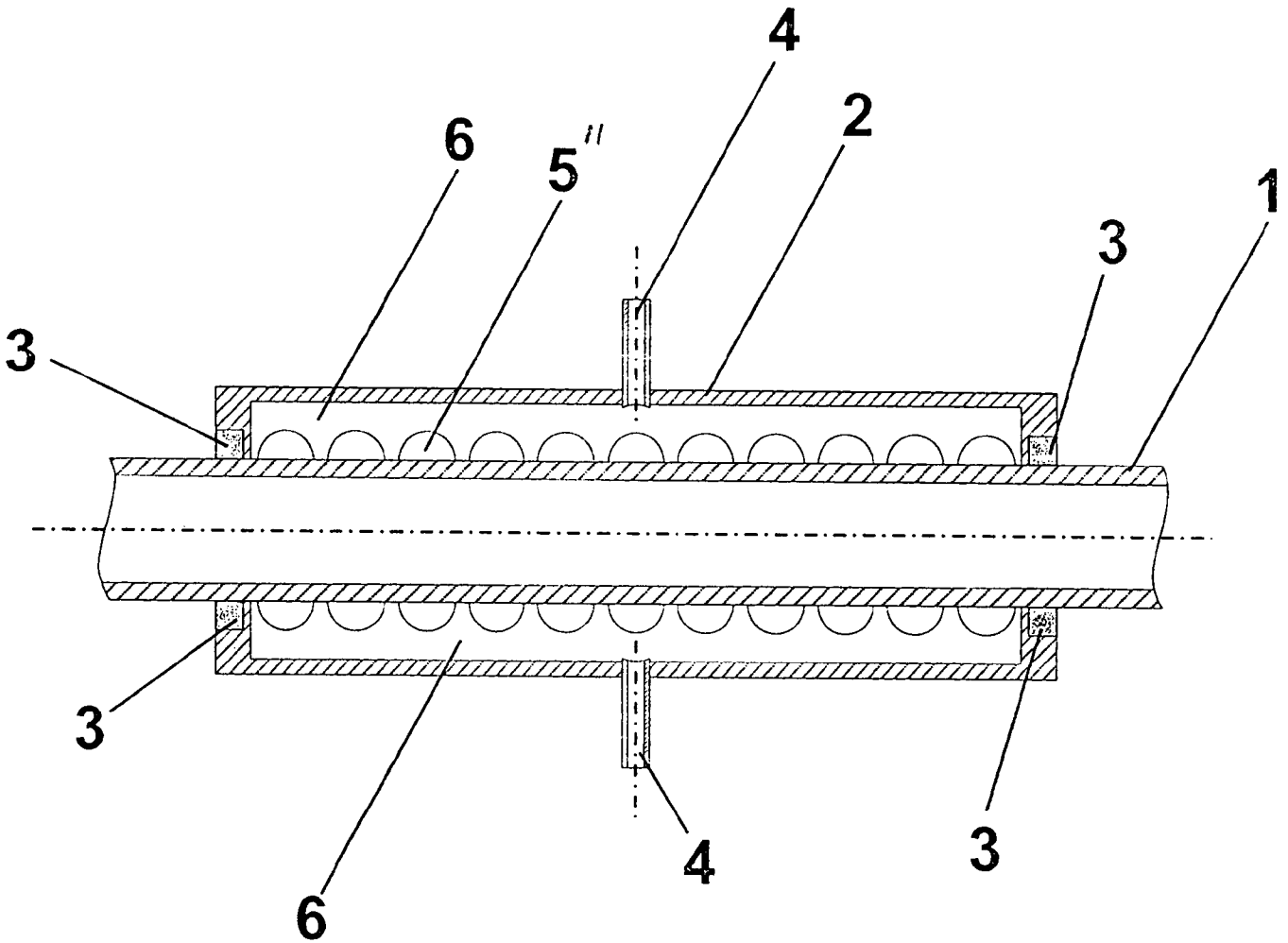
FIG. 2 is a cross-sectional view of an embodiment with fluid inlet and outlet connections arranged centrally opposite each other.

FIG. 2 shows in cross-section another embodiment, which in its configuration—but not in its operation—is similar to the embodiment shown in FIG. 1*a*. Also this arrangement comprises essentially an inner tube 1 and an outer tube 2 with a microstructure 5 formed into the inner surface of the outer tube 2 and two connections 4 and again two seal structures 3 at the opposite ends of the outer tube 2. In contrast to the first embodiment, however, the two connections 4 are arranged opposite each other on the outer tube 2, preferably displaced circumferentially by 180°, but arranged axially at the same location. They extend each to an axial groove 6 formed into the inner surface of the outer tube 2 which communicates with the circumferential passages 5 of the microstructure. A fluid to be heated is introduced through one of the connections 4 to the respective axial groove 6 and from there is distributed to the parallel passages of the microstructure 5" and flow through these passages to the second opposite groove 6 and out through the second connector 4. Depending on the application, one of the connections 4 and a groove 6 can be combined to a connection extending axially over the microstructure 5.

Figure 3:
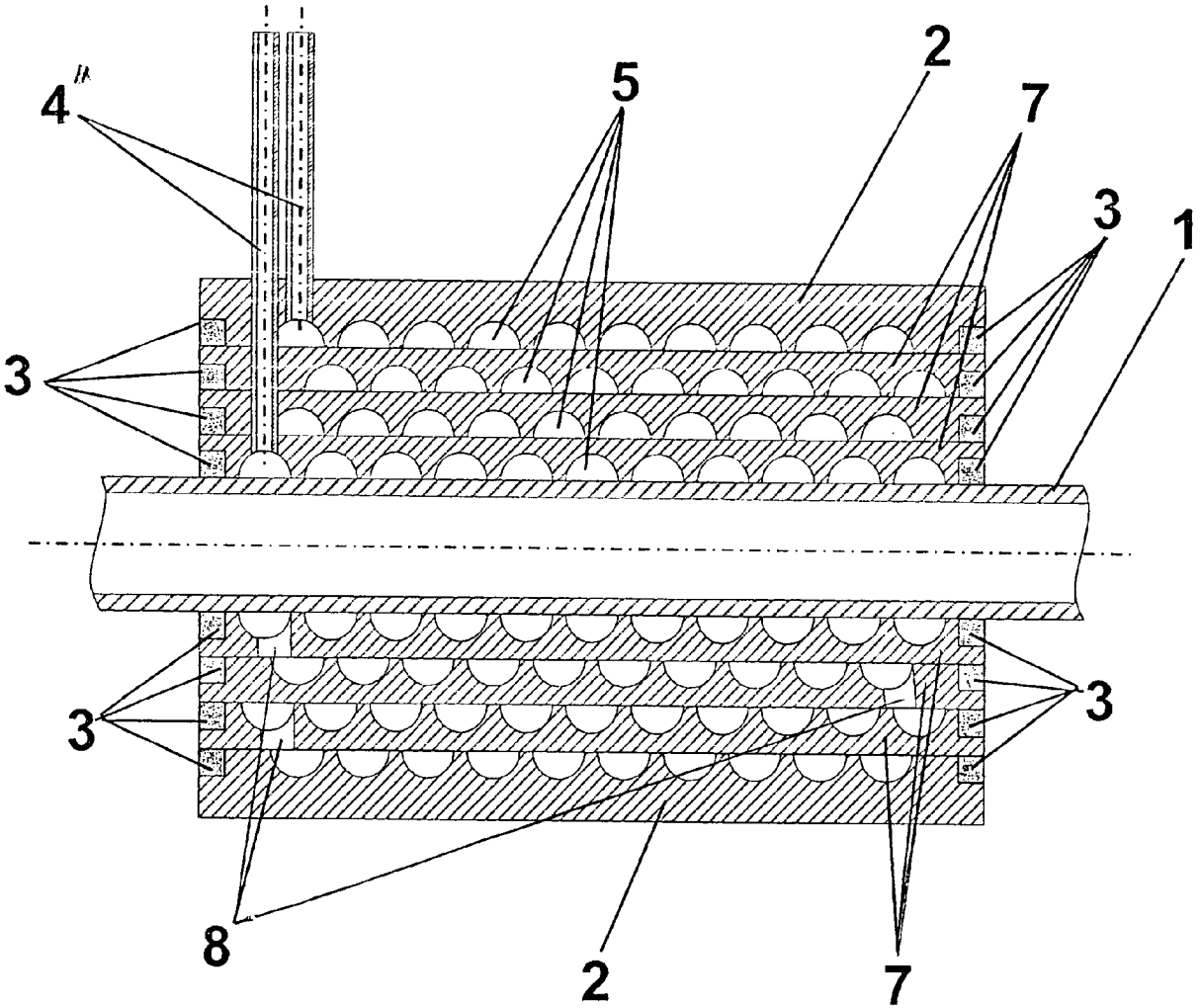
FIG. 3 is a cross-sectional view of an embodiment with three intermediate tubes disposed between inner and outer tubes.

Another embodiment of the microstructure apparatus is shown in FIG. 3. This embodiment is different from the other embodiments in that one or more intermediate tubes 7 are installed between the inner tube 1 (or cylindrical body) and the outer tube 2. All the inner or, respectively, outer surfaces are fitted to the respective adjacent tube surfaces so as to be sealed therewith as in the preceding embodiments except for the cases mentioned above. As shown in FIG. 3, the microstructure apparatus includes for example three intermediate tubes 7, each provided with a microstructure 5 forming at least one thread-like passage and each including an opening 8 extending through the wall of the intermediate tube 7 placing the thread-like passages of adjacent intermediate tubes and the outer or, respectively, inner tubes in communication with each other. All the microstructure passages are arranged by the openings 8 fluidically in series providing for a microstructure flow chain through the apparatus. The connections 4" shown in FIG. 3 are in communication with the respective ends of the flow chain wherein the preferred flow direction is from the outer to the inner microstructures, that is, counter to the temperature differential in the microstructure apparatus.

The microstructure passages 5 or the microstructure flow chain may be accessed at any location by additional connections. In this way, fluid amounts with an intermediate temperature can be withdrawn or introduced. Applications for such arrangements are present particularly in chemical engineering, wherein certain reactants or catalysts for chemical reactions must be introduced within a narrow temperature range or small fluid amounts with a certain temperature or a temperature profile must be withdrawn for example for an analysis.

Basically, the microstructure apparatus may be conceived as a chemical micro-reactor. Depending on the application, one or more reaction chambers, that is, one or more areas with increased volume of the passages may be provided in the microstructure or microstructure chain. Further, the manufacture of the whole microstructure apparatus or parts thereof, for example the inner, the intermediate or the outer tube of a catalytic material or a coating of the microstructure 5 at the contact areas with the fluid is possible. A further increase in the volume-specific heat transfer capability can be achieved by an increase in the volume-specific heat transfer area in the microstructure 5, for example, by a porous coating or by roughening of the heat transfer surface areas. The porous coating may also consist of a catalyst or the roughened heat transfer area may consist of a catalyst or be coated by a catalyst. In addition, to avoid corrosion and cavitation, the heat transfer surfaces may be provided with a protection layer consisting for example of a chemically resistant plastic or metallic material or with a wear layer of a chemically or physically deposited metal, hard material or ceramic material.

The apparatus according to the invention is formed by an expedient arrangement of microstructures or, respectively, micro-structured surfaces which, in connection with at least one throttle-like opening permit the vaporization and atomization of the fluids out of a continuous liquid stream with high efficiency.

It is pointed out that, with the vaporization or atomization of liquids flowing continuously through closed passages or pipes generally a so-called annular flow pattern occurs. Herein liquid is vaporized at the heated pipe or passage walls and forms along the walls an insulating annular layer of gas or vapors which greatly reduces the heat transfer to the liquid core of the flow. As a result evaporators or heat atomizers of conventional design operate normally with relatively low efficiency.

A way to counter the formation of such "annular flow" phenomena is to make the micro passages so small that an outer gas layer can not be formed, that is the dimensions of the micro passages do not allow for the formation of such a layer. Then however the gas layer forms closed gas bubbles which results in "vapor clogging" generating high pressure losses which again results in operational inefficiencies.

However, by combination of kinetic energy, thermal energy and continuous deflection of the flow by continuously changing the flow direction leads to a very efficient vaporization or atomization of the liquid as it is achieved with the apparatus disclosed herein. The continuous change of the flow direction during the heating process prevents the formation of an "annular flow if the microstructure totally fills and seals the space between the inner body and the outer tube. Rather the fluid flow is subjected to a constant acceleration so that the fluid is atomized by an input of kinetic energy and heat.

It is noted that, because the atomization is based on a combination of kinetic energy and heat energy a complete independence of the position and orientation of the apparatus in the space is obtained.

With the procedure according to the invention it is furthermore possible to obtain aerosols with particular desired properties. The size of the droplets can be influenced in limits by the passage geometry and by the amount of thermal energy added. Since the droplet size of the aerosol is determined by the combination of thermal energy (coupled-in heat) and kinetic energy (applied atomization impulse or, respectively fluid speed), the properties of the aerosol can be adjusted to a large extent.

An advantageous application resides for example in the charging of a gas stream with a liquid. To this end either an already existing gas/liquid mixture (aerosol) is conducted through the apparatus and converted to the desired state by the application of thermal energy or the gas/liquid mixture is formed in the apparatus. The adjustment to the desired state can be achieved by supplemental vaporization (establishing a single phase fluid in place of the two-phase fluid) or simply by a temperature adjustment of the two-phase mixture. But, as already mentioned, a certain desired aerosol state can also be established.

Exemplary Applications:

The apparatus described herein has already been used successfully in various technical applications:

Application in spray driers for an aqueous solution of a salt. The mixture was vaporized and sprayed as fog directly into an expansion chamber. In the expansion chamber the salt is deposited on the side walls.

Application as evaporator for providing for fuel in thermal electric arc drives: A liquid fuel is atomized by the apparatus described herein and is sprayed into an ionization chamber. In which the sprayed-in fog is then further treated.

Application as steam generator in a steam shower: Independent of the position a small mass flow of water is to be vaporized in such a way that a moist steam of a not too high temperature with very finely divided droplets is formed. With the present apparatus tye water can be atomized slightly above the vaporizing temperature with an extremely fine vaporization. The position or orientation independency and the freedom of re-condensation at the apparatus permits even the use in connection with a hand-held apparatus which can be freely handled.

Application as atomizer for chemical products: Within a single component a vapor can be generated which can then also be chemically decomposed. This is not possible with a sump evaporator because of boiling delays or similar effects.

The invention however is not limited to the arrangement as specifically described. It is for example possible by an incomplete sealing between the microstructure and the outer tube to provide for a relatively large volume which can be filled formed vapor/gas mixture. The gas expands by the in-coupling of thermal energy additionally in the direction of the opening providing for turbulence in the fluid flow and additional atomization of the liquid enhanced by kinetic energy.

Instead of a single channel an arrangement of intersecting channel sections may be used. This provides for impact structures which atomize the droplets upon impact and thereby intensify the atomizing process.

With the high position independence of the apparatus during vaporization and atomizing by the use of micro passages an influence of gravity is not noticeable either. Even downward vaporization against gravity forces is easily possible.

Further instead of a single supply line two (or more) supply lines may be provided through which different fluids a concurrently supplied to the vaporizer/atomizer. The different fluids are mixed as a result of the continuous direction reversal in the spiral passages (or other structures) At the same time, the fluids are heated to the desired temperature. It is unimportant, whether the fluids have the same phase or different phases (liquid/liquid, gaseous/liquid, liquid/gaseous). Consequently, the apparatus can be used as a continuous mixer-vaporizer or, respectively, mixer-atomizer.

What is claimed is:

1. A microstructure apparatus for heating and atomizing a fluid, comprising: an inner body (1) having an outer surface, an outer tube (2) concentrically surrounding said inner body (1) and having an inner surface, a microstructure formed into one of the inner surface of the outer tube (2) and the outer surface of the inner body (1) so as to form a microstructure fluid flow passage (5) in the form of a spiral groove extending between the inner body (1) and the outer tube (2), a supply passage (4) formed at one end in communication with said fluid flow passage (5) for supplying said fluid to the microstructure fluid flow passage (5), heating means included in the inner body (1) for heating the fluid in the spiral fluid flow passage (5) under pressure, said spiral microstructure forming the fluid passage between the inner body (1) and the outer tube (2)fully filling the space between the inner body (1) and the outer tube (2) and being open at an opposite axial end thereof for discharging the heated pressurized fluid through the open axial end with a spin thereby atomizing the heated fluid for efficient vaporization.

2. A microstructure apparatus according to claim 1, wherein the inner body is tubular and is closed at said one axial end, said spiral microstructure fluid passage being in the form of a groove (5) formed into the inner surface of the outer tube (2) so as to extend thread-like around the inner body (1).

3. A microstructure apparatus according to claim 1, wherein the inner surface of the outer tube (2) and the outer surface of the inner body are in sealing contact with each other to form a sealed spiral microstructure fluid passage (5) between the inner body (1) and the outer tube (2).

4. A microstructure apparatus according to claim 1, wherein a sealing ring (3) is disposed between the inner body (1) and the outer tube (2) at the other end of the outer tube (2) for closing the other end.

5. A microstructure apparatus according to claim 1, wherein at least one intermediate tube (7) is disposed between the inner body (1) and the outer tube (2) and each intermediate tube (7) is provided with a microstructure forming a screw thread-like passage between the intermediate tube (7) and a radially adjacent tube or body, the passages being in communication with one another by communication openings (8) extending through said intermediate tubes (7) so as to join the flow passages in a series flow arrangement.

6. A microstructure apparatus according to claim 1, wherein the channel walls formed by the microstructure flow passages (5) have a rough surface.

7. A microstructure apparatus according to claim 1, wherein the channels formed by said microstructure are provided with a corrosion resistant coating.

8. A microstructure apparatus according to claim 1, wherein the channels formed by said microstructure are provided with a wear-resistant coating.

9. A microstructure apparatus according to claim 7, wherein the channel walls are provided with a porous coating.

10. A microstructure apparatus according to claim 1, wherein at least parts of the microstructure apparatus consist of a catalytically active material.

11. A microstructure apparatus according to claim 1, wherein the walls forming said microstructure fluid flow passages (5) are coated with a catalytically active material.

12. A microstructure apparatus according to claim 1, wherein the heating means is an electric resistance heating element.

13. A microstructure apparatus according to claim 12, wherein said inner body (1) is an inner tube forming an open space for accommodating the heating element in the inner body (1).

14. A microstructure apparatus according to claim 12, wherein the heating element is an integral component of the inner body (1).

15. A microstructure apparatus according to claim 1, wherein the inner body (1) is in the form of a resistance heating element.

* * * * *